US010173447B2

(12) United States Patent
Zhai

(10) Patent No.: US 10,173,447 B2
(45) Date of Patent: Jan. 8, 2019

(54) PRINTER WITH MOVABLE CARRIAGE

(71) Applicant: Océ Holding B.V., Venlo (NL)

(72) Inventor: Wensheng Zhai, Richmond (CA)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/825,519

(22) Filed: Nov. 29, 2017

(65) Prior Publication Data

US 2018/0162150 A1 Jun. 14, 2018

(30) Foreign Application Priority Data

Dec. 14, 2016 (EP) ..... 16204121

(51) Int. Cl.
*B41J 25/00* (2006.01)
*B41J 19/14* (2006.01)

(52) U.S. Cl.
CPC ..... *B41J 25/001* (2013.01); *B41J 19/142* (2013.01); *B41J 2202/11* (2013.01); *B41J 2202/14* (2013.01)

(58) Field of Classification Search
CPC .... B41J 25/001; B41J 19/142; B41J 2202/14; B41J 2202/11
See application file for complete search history.

(56) References Cited

U.S. PATENT DOCUMENTS 6,367,910 B1 4/2002 Sette et al.
7,591,526 B2 * 9/2009 Mitsuzawa ..... B41J 2/15 347/19
2010/0295897 A1 11/2010 Naruse et al.

FOREIGN PATENT DOCUMENTS

DE 29 02 037 A1 7/1980
EP 2 845 742 A1 3/2015
JP 5-238004 A 9/1993
WO WO 2015/193425 A1 12/2015

OTHER PUBLICATIONS

Search Report issued in European Patent Application No. 16 20 4121, completed Jun. 9, 2017.

* cited by examiner

*Primary Examiner* — Geoffrey S Mruk
(74) *Attorney, Agent, or Firm* — Birch, Stewart, Kolasch & Birch, LLP

(57) ABSTRACT

A printer having a carriage (10) movable along a guide beam (12) in a main scanning direction (y), and a number of print heads (14) mounted on the carriage (10), each print head having a plurality of printing elements (16), wherein the carriage (10) has at least two sub-carriages (38) each of which carries at least one of the print heads (14) and is independently guided at the guide beam (12), and the sub-carriages (38) are coupled for joint movement in the main scanning direction (y) but are movable relative to one another in a sub-scanning direction (x) normal to the main scanning direction (y).

14 Claims, 3 Drawing Sheets

PRINTER WITH MOVABLE CARRIAGE

The invention relates to a printer having a carriage movable along a guide beam in a main scanning direction, and a number of print heads mounted on the carriage, each print head having a plurality of printing elements.

WO 2015193425 A1 discloses a printer of this type wherein the carriage has a main frame and a sub-frame which carries all the print heads and is movable relative to the main frame in a sub-scanning direction normal to the main scanning direction. During the print process, the carriage moves over a recording sheet in order to print a swath of an image. A detector is provided for detecting an edge of a swath that has been printed in a previous print pass, and a drive mechanism is provided for driving the sub-frame in the sub-scanning direction so as to keep the print heads aligned with the previously printed swath. In this way, it can be assured that the swath that is printed in the present pass adjoins exactly to the swath that has been printed earlier.

The invention relates in particular to a wide-format printer wherein the guide beam can have a considerable length. It is therefore difficult to provide a guide beam which is perfectly straight.

It is an object of the invention to provide a printer which is capable of achieving a high print quality in spite of a certain curvature of the guide beam.

In order to achieve this object, according to the invention, the carriage has at least two sub-carriages each of which carries at least one of the print heads and is independently guided at the guide beam, and the sub-carriages are coupled for joint movement in the main scanning direction but are movable relative to one another in a sub-scanning direction normal to the main scanning direction. The sub carriages are configured to follow a curvature of the guide beam.

If a carriage is large enough to accommodate all the print heads of the printer, then it must have considerable dimensions in the main scanning direction, and there will be a considerable distance between the first print head and the last print head as seen in the main scanning direction. When the guide beam is curved and the carriage moves along this curved guide beam, the curvature translates into a slight rotation of the carriage.

Due to the large distance between at least two of the print heads, the rotation induces an offset between these print heads in the sub-scanning direction, and this offset results in an artefact in the printed image due to misalignment of the pixel lines printed with the print heads.

In the printer according to the invention, the print heads are distributed over at least two sub-carriages. The sub-carriages are coupled for joint movement in the main scanning direction but are movable relative to one another in a sub-scanning direction normal to the main scanning direction. The above mentioned effect of the slight rotation of the carriage rotation can be counteracted by movement of the individual movements of the sub-carriages in the sub-scanning direction.

More specific optional features of the invention are indicated in the dependent claims.

In an embodiment, the sub-carriages are configured to follow the curvature of the guide beam independently of one another. The sub-carriages are substantially free to move with respect to one another in the sub-scanning direction under the influence of the curvature of the guide beam. This allows each individual sub-carriage to accurately follow the curvature of the guide beam.

In an embodiment, a plurality of print heads are mounted on each sub-carriage. The print heads are then advantageously distributed over at least two sub-carriages, so that the distances, in the main scanning direction, between the print heads that are mounted on the same sub-carriage becomes smaller. Consequently, the misalignment is reduced, and artefacts can be avoided even in case of a curved guide beam.

In another embodiment, the sub-carriages are movable relative to one another parallel to the sub-scanning direction. Preferably, the sub-carriages are movable relative to one another only in the sub-scanning direction. The sub-carriages are preferably connected to one another, such that the sub-carriages are only moveable with respect to one another in the sub-scanning direction.

In one embodiment each of the sub-carriages carries only a single print head. Then, since each sub-carriage is guided directly at the guide beam, all print heads will have the same position in sub-scanning direction when they pass a given point on the guide beam during their movement in the main scanning direction. As a consequence, a good alignment of the printed pixel lines can be assured.

The individual sub-carriages may be interconnected by links which are stiff in the main scanning direction but flexible in the sub-scanning direction.

When the sub-carriages project relatively far from the guide beam, the ends of the sub-carriages opposite to the guide beam may be supported on a support rail which extends in parallel to the guide beam. Preferably, each sub-carriage is supported on the support rail via a spherical support body (ball) which permits the sub-carriage to move with low friction relative to the support rail in both, the main scanning direction and the sub-scanning direction.

In another embodiment each sub-carriage may carry a plurality of print heads, which, together, cover a larger distance in the sub-scanning direction, so that a swath with a larger width can be printed in a single pass of the carriage. The print heads mounted on the same sub-carriage are offset relative to one another in the main scanning direction and are staggered such that the printing elements are arranged with equal spacings in the sub-scanning direction even at the junction between two neighboring print heads.

In an embodiment, adjacent sub-carriages are coupled to one another to prevent relative movement of said sub-carriages in the main scanning direction, but adjacent sub-carriages are moveably coupled to one another to allow for relative movement of said sub-carriages in the sub-scanning direction. Preferably, the sub-carriages are interconnected by links which are rigid or stiff in the main scanning direction to prevent movement of the sub-carriages with respect to one another in the main scanning direction and which links are flexible in the sub-scanning direction to enable movement of the sub-carriages with respect to one another in the sub-scanning direction. The rigidity or stiffness of the links in the main scanning direction fixes the distances between adjacent sub-carriages in the main scanning direction. These distances substantially do not vary as the carriage travels along the guide beam. The flexibility of the links however provides for movement in the sub-scanning direction. Ergo, the flexibility of the links in the sub-scanning direction is defined relative to the rigidity in the main scanning direction. The rigidity prevents relative movement between sub-carriages in the main scanning direction, while the flexibility provides relative movability between sub-carriages in the sub-scanning direction. In an embodiment, the links may be deformable in the sub-scanning direction, while preferably the width of the links in the main scanning direction is substantially maintained or constant.

In an embodiment, each sub-carriage comprises a runner which contacts and follows the guide beam, such that each runner actuates its respective sub-carriage in the sub-scanning direction in correspondence to the curvature of the guide beam. The runner may be in the form of a runner block, slider, or follower wheel. As the runners during the movement of the carriage run over the guide beam, the runners directly 'feel' any evenness or curvature of the guide beam. Due to the contact between the runner and the guide beam, curvature of the guide beam moves the runner in the sub-scanning direction. The runner directs this movement to the sub-carriage. Thereby, the sub-carriage accurately follows the guide beam. Preferably, each runner is configured to individually move its respective sub-carriage independent of the other sub-carriages. This results in an increased accuracy when following the guide beam's curvature.

In an embodiment, each sub-carriage comprises a support beam for supporting one or more print heads, wherein each runner is mounted at an end of its respective support beam adjacent the guide beam. The support beams extend in the sub-scanning direction away from the guide beam. The runner forms an end of the support beam and is in contact with the guide beam.

In another embodiment, each sub-carriage comprises a restrictor which limits movement of the sub-carriage such that each sub-carriage follows the curvature of the guide beam. The restrictor prevents the sub-carriage or runner from moving away from the guide beam. The restrictor may comprise holding means for maintaining constant contact between the sub-carriage or runner and the guide beam. The holding means may be e.g. an urging element or a form fit profile. The restrictor preferably limits or restricts movement of the sub-carriage or runner in all directions except along the guide beam. In one example, the guide beam comprises a rail, wherein the rail has a profile providing a form-fit for restricting the movement of the sub-carriages or runners.

Embodiment examples will now be described in conjunction with the drawings, wherein.

Figure 1:
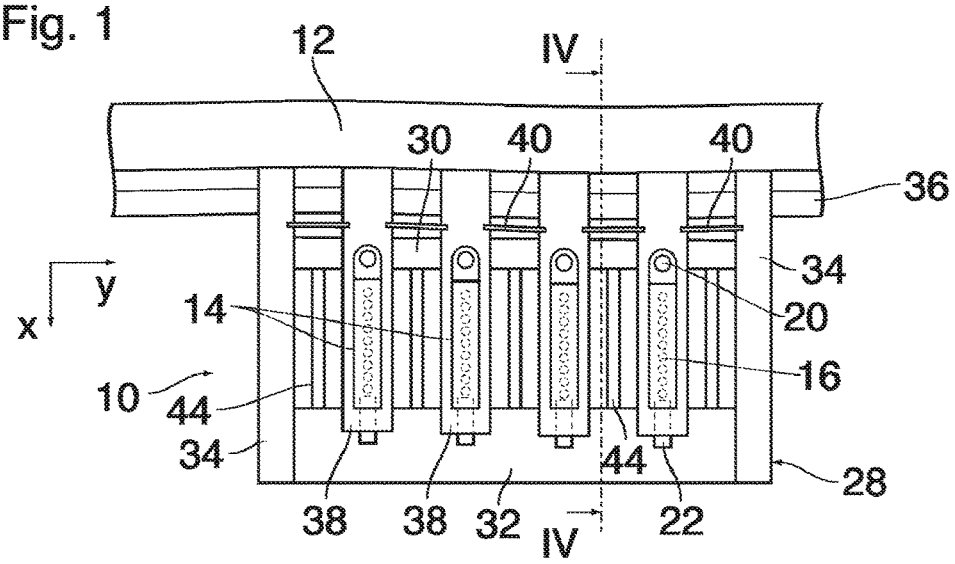
FIG. 1 is a schematic top plan view of a printer according to an embodiment of the invention.

The printer shown in FIG. 1 has a carriage 10 movable back and forth in a main scanning direction y and guided along a guide beam 12, and a plurality of print heads 14 mounted on the carriage 10. Each print head 14 has a plurality of printing elements 16 which are aligned in a row extending along a sub-scanning direction x normal to the main scanning direction y. In this example, the printer is an ink jet printer, and the printing elements 16 take the form of downwardly facing nozzles for expelling ink droplets onto a recording medium supported on a print surface 18 (FIG. 4) disposed below the guide beam 12 and the carriage 10.

The four print heads 14 shown in this example may be provided for printing with inks in four different colors and are aligned with certain spacings in the main scanning direction y.

When the carriage 10 scans the recording medium in the main scanning direction y, the printing elements 16 of the four print heads may be fired at appropriate timings for printing a swath of an image. Then, the recording medium will be advanced in the sub-scanning direction x by a distance corresponding to the width of the sprinted swath and, accordingly, the length of the print heads 14 in the sub-scanning direction x, so that an adjacent swath of the image may be printed in the next scan pass.

Adjusting mechanisms 20 and 22 are provided for each print head 14 so that the positions of the print heads relative to the carriage 10 may be adjusted in some or all of their six degrees of freedom. In this way, the print heads 14 may be adjusted such that ink dots 24, 26 (FIG. 2) that have been printed with the different print heads 14 form a regular pattern or screen.

The carriage 10 is composed of a plurality of parts that are movable relative to one another. A first part is configured as a frame 28 having longitudinal beams 30, 32 connected by cross-beams 34. The ends of the cross-beams 34 facing the guide beam 12 are configured as runner blocks which engage a rail 36 that is attached to the guide beam 12 so that the frame 28 is guided along the guide beam (see also FIG. 4). The rail 36 has a profile providing a form-fit, so that the position of the frame is fixed in the sub-scanning direction x. Alternatively, the runner may comprise a contact element, such as a wheel or slider, and an urging element, such as a spring, for urging the contact element against the guide beam.

Other parts of the carriage 10 are configured as sub-carriages 38 which extend in the sub-scanning direction x. In the embodiment shown in FIG. 1, each sub-carriage 38 carries a single print head 14.

Similarly as the cross-beams 34, the ends of the sub-carriages 38 facing the guide beam 12 are configured as runner blocks engaging the rail 36, so that each sub-carriage is individually guided along the guide beam 12.

The sub-carriages 38 and the cross-beams 34 are chained together by links 40 which are rigid in the main scanning direction y but flexible in the sub-scanning direction x. Consequently, the sub-carriages 38 are movable relative to one another and relative to the frame 28 in the sub-scanning direction x.

In case of a wide format printer the guide beam 12 may have a length of more than 840 mm (width of an A0 sheet) and it is therefore difficult to provide a guide beam that is perfectly straight. It must therefore be considered that the guide beam 12 can be curved or "wavy" as has been shown exaggeratedly in FIG. 1. When the carriage 10 moves along the guide beam 12 (driven by a drive mechanism which has not been shown here), the frame 28 and the sub carriages 38 can follow the curvature of the guide beam 12 and the rail 36 independently of one another. Consequently, when the sub-carriages 38 pass, one after the other, a given point on the guide beam 12 (specified by a certain value of the y-coordinate) all print heads 14 will have exactly the same position in the sub-scanning direction x. This minimizes the offset in x-direction of the ink dots 24, 26 printed at adjacent (or identical) y-positions.

Figure 2:
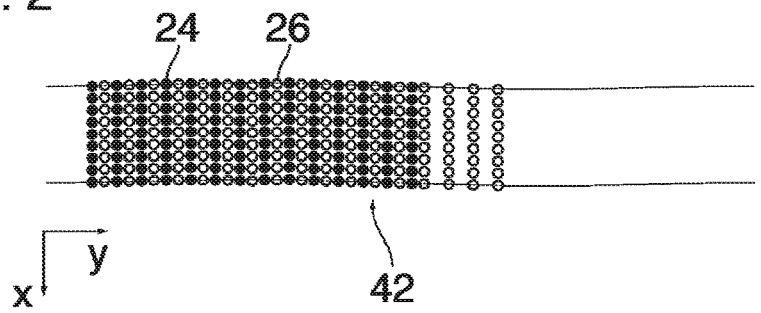
FIG. 2 shows a pixel pattern printed with the printer according to FIG. 1.

As an example, FIG. 2 shows a portion of a printed swath 42 printed with the printer shown in FIG. 1. Ink dots 24 printed by the second print head 14 (print heads counted from left to right in FIG. 1) are represented by black dots, and ink dots 26 printed by the third print head 14 are indicated by white dots. In this example, the screen has been designed such that the black dots 24 fill the gaps between the white dots 26 in each pixel line. Although the swath 42 as a whole has the same waviness as the guide beam 12 (this waviness is not perceptible to the human eye), the pattern of the dots 24 and 26 is hardly disturbed and is essentially uniform over the entire swath—and also over subsequent swaths that will be printed later.

Figure 3:
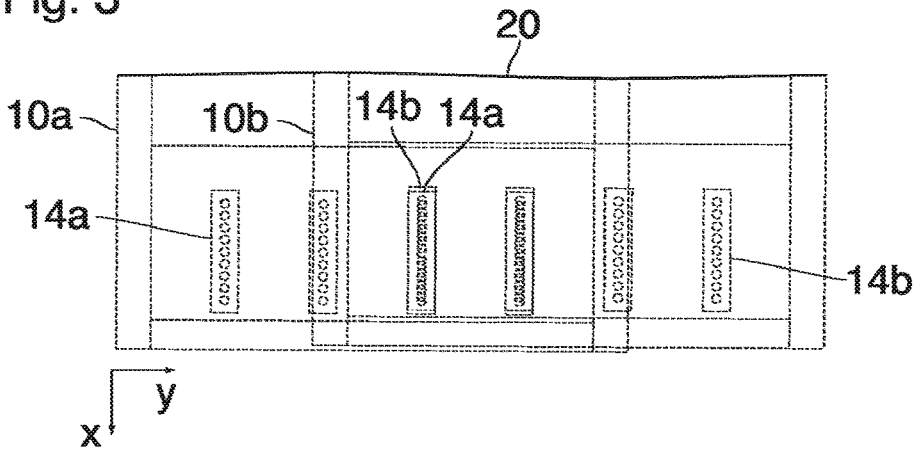
FIG. 3 is a diagram for explaining a problem solved by the invention.

For comparison, FIG. 3 illustrates a situation that would be encountered if the print heads 14 were mounted rigidly on the carriage 10. Reference numerals 10*a* and 10*b* in FIG. 3 designate two positions of the carriage 10 which are reached at different timings during the movement of the carriage along the guide beam 20. The print heads of the carriage in the position 10*a* are designated as 14*a* and the print heads in the carriage position 10*b* are designated as 14*b*. By comparing the positions of the two rightmost print heads 14*a* to the positions of the two leftmost print heads 14*b* (which have the same y-coordinate, respectively) it can be seen that there is a substantial offset between the printing elements in the sub-scanning direction x. Even if the curvature of the guide beam 12 is invisibly small, the offset may be in the order of magnitude of the distance between the printing elements 16. This offset would disturb the pattern of the dots 24, 26 shown in FIG. 2 and would therefore lead to visible artefacts in the printed image. In the invention, these artefacts are avoided by allowing the sub-carriages 38 to move in the sub-scanning direction x individually and independent of the frame 28.

In general, the waviness of the guide beam 20 induces a rotation of the frame 28 of the carriage about an axis normal to the x-y-plane, and if the print heads were mounted rigidly on the frame, as in FIG. 3, the rotation of the frame would induce a movement of each print head on a circle with a certain radius. The differences between the radii for different print heads would be proportional to the spacings between these print heads. The movement of each print head in the sub-scanning direction x would be proportional to the radius describing the rotary movement of the print head. Consequently, the offsets between ink dots printed with different print heads would generally be proportional to the spacings between the print heads in the main scanning direction y. Thus, for a given, inevitable, curvature of the guide beam 12, the invention permits to increase the spacings between the print heads 14 without inducing visible artefacts. This permits to use print head assemblies with a larger number of print heads (and consequently a large spacing in y-direction between the first and the last print head) and it also permits to provide larger gaps between adjacent print heads.

In the example shown in FIG. 1, this latter effect has been taken advantage of by providing LED-blades 44 for curing the ink (e.g. a UV-curable ink) in each gap between adjacent print heads 14. Consequently, each of the four print heads 14 can be flanked by symmetrically arranged LED-blades 44, so that the curing pattern does not change when the carriage 10 moves along the guide beam 12 in opposite directions. This results in a more uniform appearance of the printed image.

Another advantage achieved by the invention is that the procedures and mechanisms for adjusting and aligning the print heads and the carriage 10 as a whole can be simplified. For example, in a conventional printer, the alignment of the print heads would be affected by a rotation of the carriage 10 as a whole about an axis normal to the x-y plane, and this effect would have to be compensated for by adjusting the print heads 14 individually or by adjusting the rotary position of the entire carriage 10. In the printer according to the invention, these adjustment operations can be dispensed with because the x-position of all print heads depends only upon the position of the surface of the guide beam 12 and upon the design of the sub-carriages 38 (which can have an identical design and can be manufactured with high accuracy).

Moreover, the positions of the print heads 14 in the sub-scanning direction x are less sensitive to any possible deformations of the carriage frame which may be induced by external forces acting upon the frame. For example, such forces may occur when a carriage cover 46 (shown in phantom lines in FIG. 4) is opened and closed in order to protect the print heads while permitting access to the adjusting mechanisms 20, 22.

Figure 4:
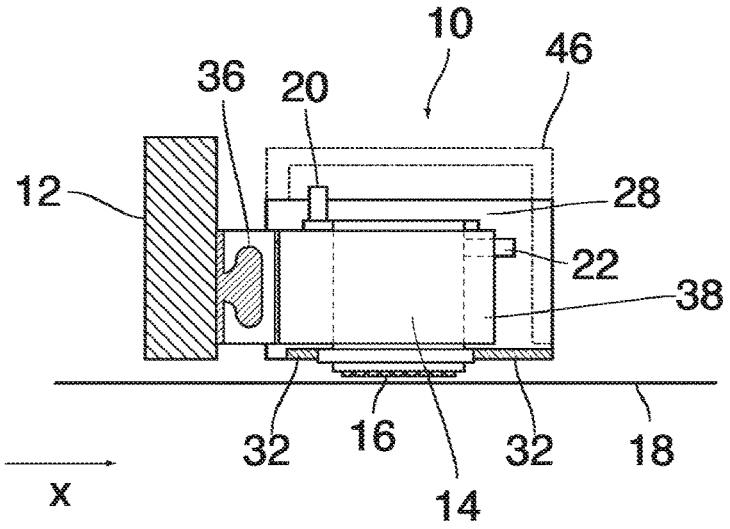
FIG. 4 shows the printer in a sectional view taken along the line IV-IV in FIG. 3.

As can further be seen in FIG. 4, the sub-carriages 38 project from the rail 36 in cantilever fashion and are not supported by the frame 28 at the end opposite to the guide beam 12.

In an alternative embodiment the sub-carriages could be guided in the frame 28 so as to be slidable in the frame 28. Further, the sub-carriages 38 could be spring-biased against the rail 36 so that the rail would not need to be profiled.

Figure 5:
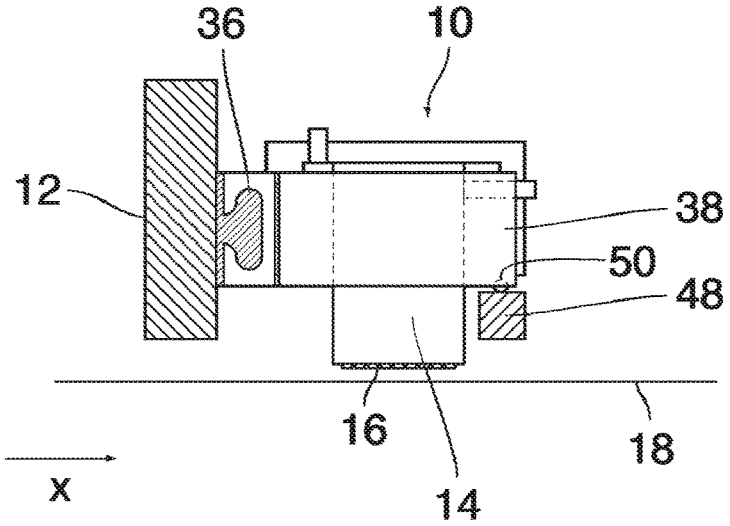
FIG. 5 is a sectional view showing a printer according to a modified embodiment.

FIG. 5 illustrates an embodiment wherein a rigid support beam 48 extends over the entire width of the print surface 18 (just as the guide beam 12). In this embodiment the end of each sub-carriage 38 opposite to the guide beam 12 is supported on the support beam 48 by a spherical ball 50. The ball 50 is held in a bearing formed in the sub-carriage 38, and the bearing permits the ball 50 to rotate in any direction, so that the ball may roll over the surface of the support beam 48 with low friction when the carriage 10 moves along the guide beam 12. The ball 50 can also roll over the surface of the support beam 48 in the sub-scanning direction x when the curvature of the guide beam 12 induces movements of the sub-carriage 38 in the x-direction.

It is not mandatory that each sub-carriage 38 carries only a single print head.

Figure 6:
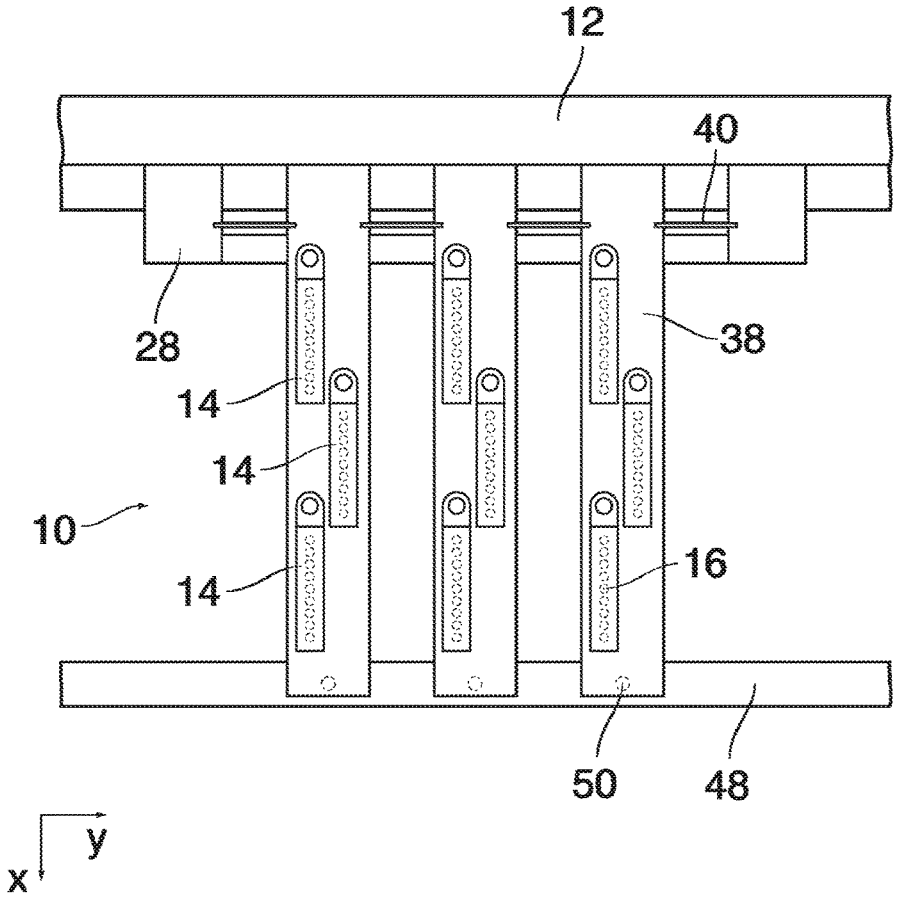
FIG. 6 is a top plan view of a printer according to yet another embodiment.

FIG. 6 shows an embodiment in which each sub-carriage 38 carries three print heads 14 staggered such that the rows of printing elements 16 adjoin one another with spacings that are equal to the spacings between neighboring printing elements 16 within each print head. Thus, it is possible to print, in a single pass of the carriage 10, an image swath that has a width that is three times the width of the swath printed with the printer shown in FIG. 1.

The invention claimed is:

1. A printer having a carriage movable along a guide beam in a main scanning direction, and a number of print heads mounted on the carriage, each print head having a plurality of printing elements, wherein the carriage has at least two sub-carriages each of which carries at least one of the print heads and is independently guided at the guide beam, and the sub-carriages are coupled for joint movement in the main scanning direction, characterized in that the sub-carriages are movable relative to one another in a sub-scanning direction normal to the main scanning direction, and wherein the sub-carriages are configured to follow a curvature of the guide beam, wherein each sub-carriage comprises a runner which contacts and follows the guide beam, such that each runner actuates its respective sub-carriage in the sub-scanning direction in correspondence to the curvature of the guide beam.

2. The printer according to claim 1, wherein the sub-carriages are configured to follow a curvature of the guide beam independently of one another.

3. The printer according to claim 1, wherein adjacent sub-carriages are coupled to one another to prevent relative movement of said sub-carriages in the main scanning direction, but wherein adjacent sub-carriages are moveably coupled to one another to allow for relative movement of said sub-carriages in the sub-scanning direction.

4. The printer according to claim 1, wherein the sub-carriages are interconnected by links which are rigid in the main scanning direction to prevent movement of the sub-carriages with respect to one another in the main scanning direction and which links are flexible in the sub-scanning direction to enable movement of the sub-carriages with respect to one another in the sub-scanning direction.

5. The printer according to claim 1, wherein each runner is configured to individually move its respective sub-carriage independent of the other sub-carriages.

6. The printer according to claim 1, wherein each sub-carriage comprises a support beam for supporting one or more print heads, wherein each runner is mounted at an end of its respective support beam adjacent the guide beam.

7. The printer according to claim 1, wherein each sub-carriage comprises a restrictor which limits movement of the sub-carriage such that each sub-carriage follows the curvature of the guide beam.

8. The printer according to claim 7, wherein the guide beam comprises a rail, wherein the rail has a profile providing a form-fit for restricting the movement of the sub-carriages.

9. The printer according to claim 8, wherein each runner engages the rail, and wherein the rail has a profile providing a form-fit for restricting the movement of the runners.

10. The printer according to claim 1, wherein each sub-carriage is in engagement with a rail formed at the guide beam and having a profile which profile defines the position of the sub-carriage in the sub-scanning direction.

11. The printer according to claim 1, wherein the carriage comprises a frame which is guided along the guide beam independently of the sub-carriages.

12. The printer according to claim 1, wherein a support beam extends in parallel with the guide beam, and each sub-carriage is supported on the support beam by a low-friction bearing.

13. The printer according to claim 12, wherein the low-friction bearing comprises a spherical ball.

14. The printer according to claim 1, wherein the carriage has an ink curing device disposed in a gap between two adjacent sub-carriages.

* * * * *